United States Patent [19]

Landers

[11] 4,045,809

[45] Aug. 30, 1977

[54] PHOTOGRAPHIC FILM DEVELOPING APPARATUS

[75] Inventor: Richard D. Landers, Salem, Oreg.

[73] Assignee: Kreonite, Inc., Wichita, Kans.

[21] Appl. No.: 485,209

[22] Filed: July 2, 1974

[51] Int. Cl.[2] ..... G03D 3/08

[52] U.S. Cl. ..... 354/322; 134/64 P; 198/690; 354/339

[58] Field of Search ..... 354/297, 312, 315, 316, 354/319, 320, 321, 322, 339, 345; 134/64 P, 122 P; 226/92, 107; 271/204; 198/DIG. 13, 41

[56] References Cited

U.S. PATENT DOCUMENTS

| | | | |
|---|---|---|---|
| 1,525,363 | 2/1925 | Boyce | 354/297 X |
| 2,191,850 | 2/1940 | Debrie | 354/321 |
| 2,940,584 | 6/1960 | Kunz | 198/41 |
| 3,023,686 | 3/1962 | Meyer | 198/41 X |
| 3,033,351 | 5/1962 | Dutch | 354/322 X |
| 3,156,173 | 11/1964 | Meyer | 198/41 X |
| 3,192,845 | 7/1965 | Schmidt | 354/321 |
| 3,353,470 | 11/1967 | Zane | 354/322 |
| 3,662,665 | 5/1972 | Meeussen et al. | 134/64 P |
| 3,762,300 | 10/1973 | Hart et al. | 354/312 |

FOREIGN PATENT DOCUMENTS

| | | | |
|---|---|---|---|
| 1,149,990 | 6/1963 | Germany | 226/92 |

*Primary Examiner*—Fred L. Braun
*Attorney, Agent, or Firm*—Lawrence E. Laubscher; Eugene D. Farley

[57] ABSTRACT

Photographic film developing apparatus comprises a sequence of adjacent, horizontally aligned chambers communicating with each other at their top and bottom portions. Each is adapted to contain a selected film-treating fluid agent. An infeed port communicates with one terminal chamber of the sequence and a dishcarge port with the other.

Magnetic carriages mounting releasable film grips are dimensioned to traverse the chambers, trailing the film behind them. The carriages are actuated by a magnetic element mounted for reciprocation adjacent the chambers and associated with a reciprocating drive. Reciprocation of the magnetic element in a vertical plane drives the carriages and the film through one chamber after the other, thereby exposing the film sequentially to the action of the treating agents contained in the respective chambers.

6 Claims, 15 Drawing Figures

2
54
52
36a
36b
30b
32b
34b
30a
32a
34a
28b
28a
38a
44
43
46
120
116
118
40
96
98
22
24
122
124
126
7
3
112
108
110
114
20
26
28
30
32
34
36
38

124
64
67
66
32
34
36

66
67
96
64
70
68
72

104
102
106
34
32
6
100
36

146
210
194
176
178
180
182
168
196
184
166
136
150
162
198
170
138
142
160
164
172
200
202
140
154
156
10
204
206
155
174
186
192
130
188
190
132
134

100
68

50
48
36
72
38

FIG. 2
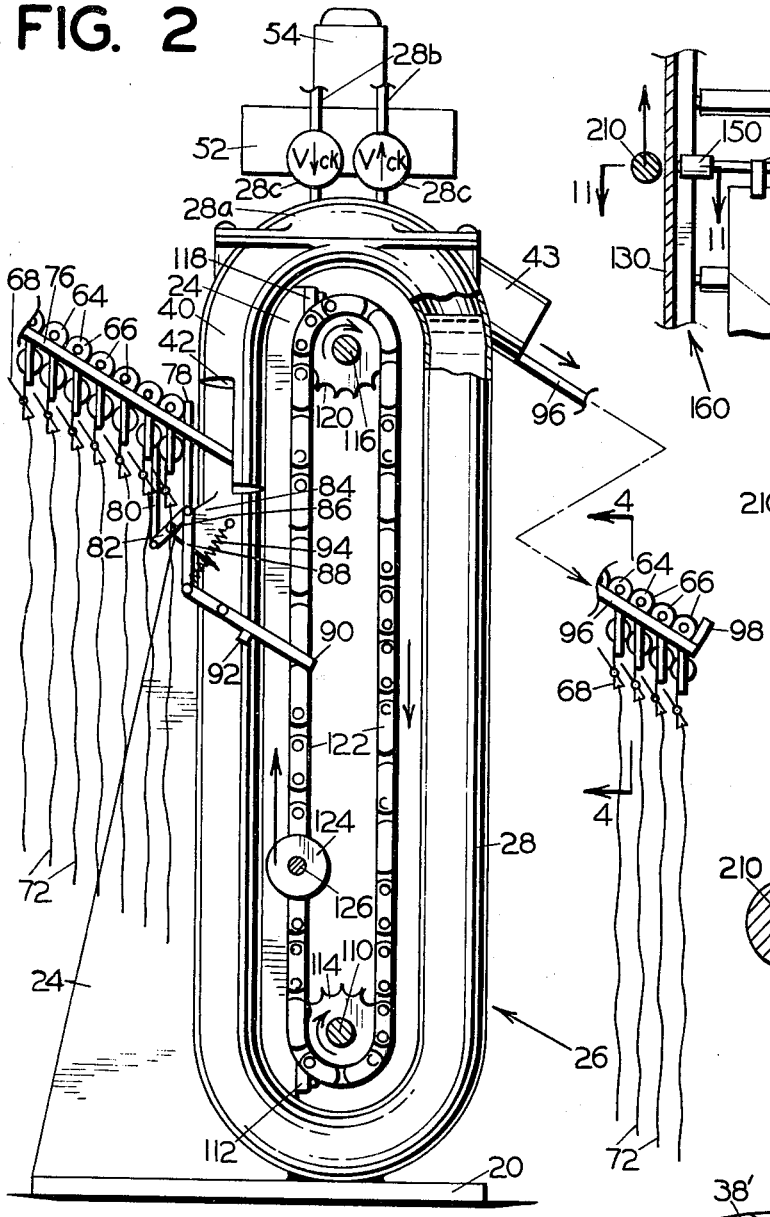
FIG. 10
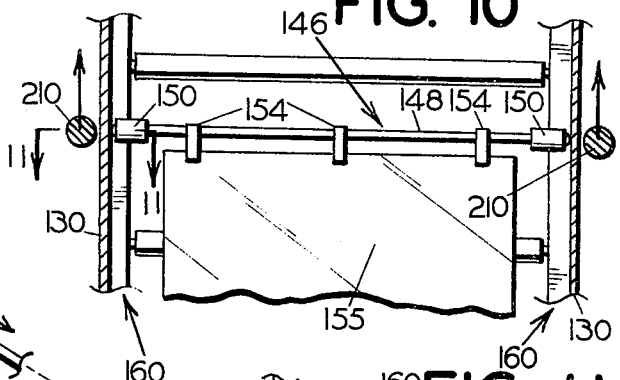
FIG. 11
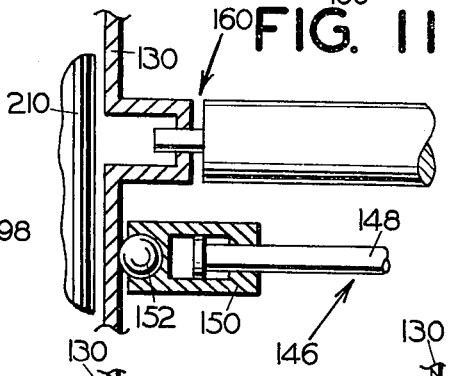
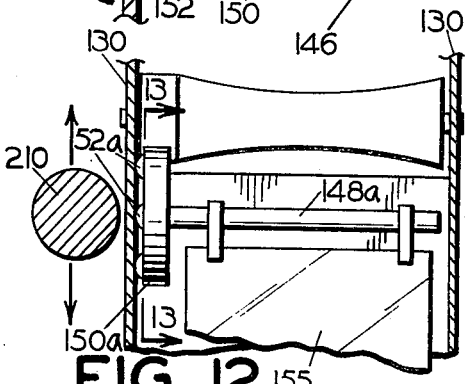
FIG. 12
FIG. 13
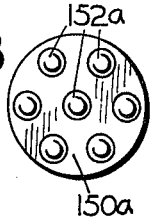
FIG. 8
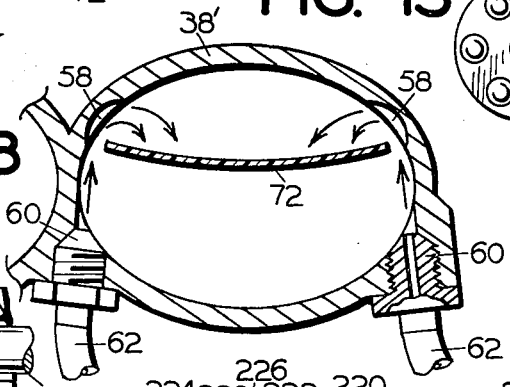
FIG. 14
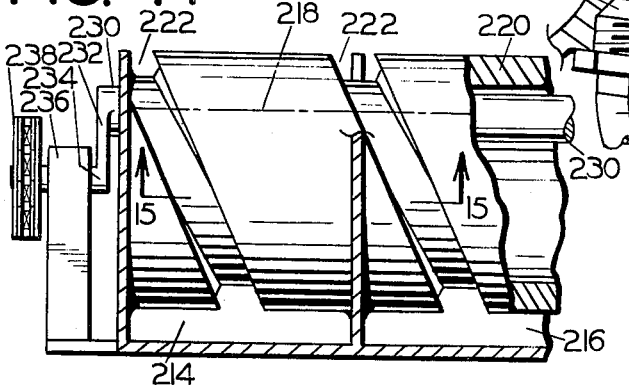
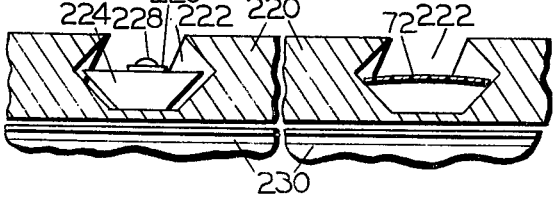
FIG. 15

PHOTOGRAPHIC FILM DEVELOPING APPARATUS

BACKGROUND OF THE INVENTION

This invention pertains to apparatus for processing photographic film.

In the developing and printing of either black-and-white or color photographic film, it is usual practice to pass the film through an appropriate sequence of treating solutions and thereafter to wash it and dry it. This sequence is carried out in relatively large tanks, using relatively complex machinery for moving the film from one tank to the next.

Since the tanks are large, there necessarily is considerable waste attendant upon the introduction and removal of the treating solutions. Also, the sensitive contents of the tanks are subject to excessive atmospheric oxidation. Still further, an element of danger to operating personnel attends the operation of some transporting mechanisms, particularly since adjustments and changes may be required to be made in the dark.

It is the general object of the present invention to provide apparatus for processing photographic film which overcomes the foregoing disadvantages of the prior art apparatus and which minimizes waste of the treating chemicals, minimizes oxidation thereof, and minimizes the hazard of injury to operating personnel.

Still further objects of the present invention are the provision of apparatus for processing photographic film which is adaptable for use with either black-and-white or color films, which may be used with films of various lengths and widths; which is easy to clean and maintain; which obtains maximum efficiency from the treating solutions; which has provision for drying of the treated film without operator attention; which may easily be changed over from one type of film processing to another; which makes possible relible, uniform and efficient processing of the film; which minimizes damage to the film emulsion during transport of the film from one treating chamber to the next; which prevents the inadvertent transfer of the treating liquid from one chamber to the next; and which is relatively compact, and inexpensive to build and service.

The foregoing and other objects of the present invention are achieved by the provision of photographic film developing apparatus which in its broad aspect comprises a sequence of adjacent, horizontally aligned chambers communicating with each other at their top and bottom portions and each of which is adapted to contain a selected film-treating fluid agent. An infeed port communicates with one terminal chamber of the sequence and a discharge port with the other.

One or more magnetic carriages mounting releasable film grip means are dimensioned to traverse the chambers, guided by suitable guide means. The carriages are actuated by a magnetic element mounted for reciprocating movement adjacent the chambers and associated with a suitable reciprocating drive. Reciprocation of the magnetic element in a vertical plane drives the carriages and the films trailing thereafter through one chamber after the other, thereby exposing the film sequentially to the action of the treating agents contained in the respective chambers.

THE DRAWINGS

In the drawings:

FIG. 2 is a sectional view taken along line 2—2 of FIG. 1, partly broken away to show the interior construction;

FIG. 8 is a detail transverse sectional view of the apparatus of FIGS. 1 and 2 illustrating fluid means for spacing the film in transit from the chamber walls thereby lessening friction between the film strand and the chamber wall.

FIG. 10 is a fragmentary, detail sectional view taken along line 10—10 of FIG. 9;

FIG. 11 is a fragmentary sectional view taken along line 11—11 of FIG. 10 and illustrating a film supporting sub-assembly employed in the embodiment of FIGS. 9 and 10;

FIG. 12 is a fragmentary sectional view similar to FIG. 11 and illustrating the film supporting sub-assembly in alternate form;

FIG. 13 is a detail plan view looking in the direction of the arrows of line 13—13 of FIG. 12;

FIG. 14 is a fragmentary, longitudinal sectional view of the presently described apparatus in a third embodiment; and FIG. 15 is a fragmentary, detail sectional view taken along line 15—15 of FIG. 14 and further illustrating the third embodiment of the invention.

DESCRIPTION OF THE PREFERRED EMBODIMENTS

Figure 1:
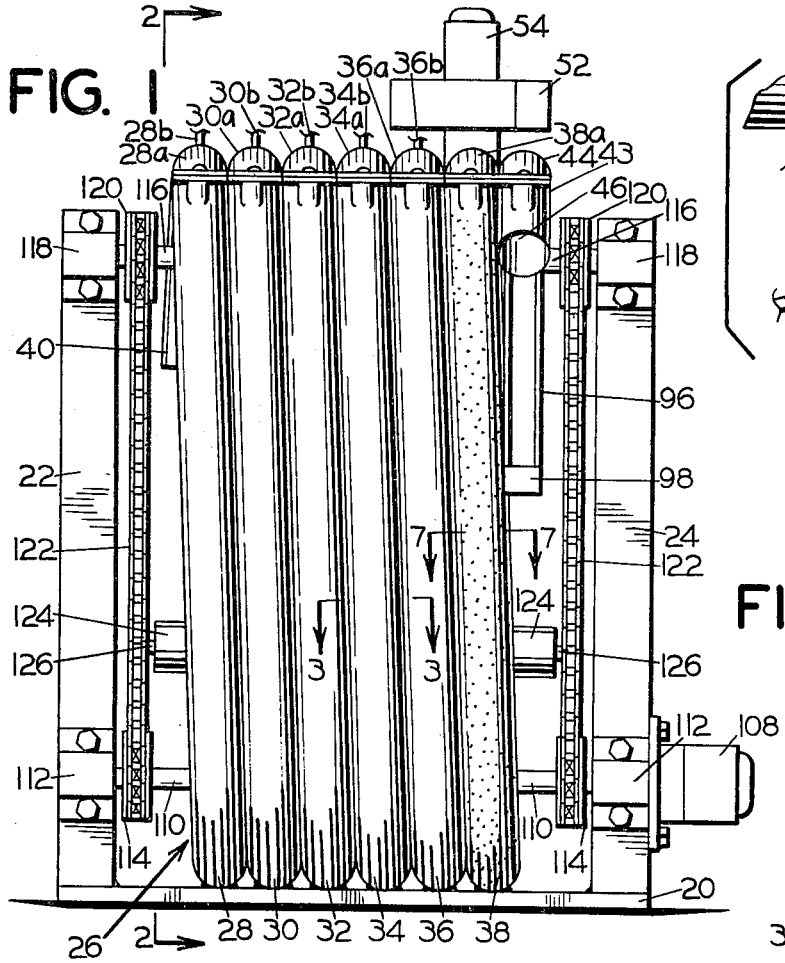
FIG. 1 is a view in side elevation of the hereindescribed photographic film developing apparatus in a first embodiment.

As noted above, the photographic film developing apparatus of my invention is applicable to the developing and/or printing of photographic film by passing the film successively through the prescribed treating solutions. The film may be either black and white film or color film. It may be in the form of transparency strips such as are used widely in amateur photography, or in the form of wide sheets such as are used in professional photography.

As shown in the drawings, the herein described apparatus is illustrated in three separate embodiments.

Embodiment of FIGS. 1-8

The embodiment of FIGS. 1-8 is characterized by the application in the apparatus of the invention of a continuous tube in the form of a spiral or helix, the individual convolutions of which provide separate treating chambers.

The apparatus is mounted on a substantial base 20 provided with upright posts or standards 22, 24 fixed to the base a spaced distance apart.

Mounted on the base between the posts is a helical tube indicated generally at 26. This may be made of plastic, glass or metal and is made rigid to the base at the bottom of each convolution of the spiral.

A tube of oval cross section is most suitable since it assures proper alignment of the film strip within the tube. An oval tube would contact only the side margins of the film strip and therefore would not harm the delicate emulsion surface.

In the illustrated form of the invention, there are six loops or convolutions closely adjacent to each other and forming a sequence of horizontally aligned chambers or cells communicating with each other at their top and bottom portions. The individual cells are indicated at 28, 30, 32, 34, 36, 38 respectively. Each is provided with a flanged cap 28*a*, 30*a*, 32*a*, 34*a*, 36*a* and 38*a* respectively.

Certain of the caps are provided with conduits 28*b*, 30*b*, 32*b*, 34*b*, 36*b*, respectively, for the introduction of an inert gas into the space above the fluid contents of the chambers for the purpose of preventing oxidation of the treating liquids. As shown in the case of conduit 28*b*, FIG. 2, these conduits may include appropriately arranged check valves 28*c* for flow control purposes.

The caps are removably affixed to the upper ends of the chambers by suitable means, for example by means of bolts penetrating flanges with which the caps may be provided. This enables removal of the caps for purposes of cleaning the chambers, filling them and emptying them.

Although the spiral may assume various dimensions, it is preferred to elongate and flatten its vertical segments, as illustrated in FIG. 2, in order to provide vertically disposed chambers of substantial height which correspondingly contain substantial depths of treating liquids without requiring an inordinate volume thereof.

The spiral begins with an upper fragmentary segment 40 cut away to provide an infeed port 42, FIG. 2. This communicates with the upstream terminal chamber 28 of the sequence of chambers.

The spiral terminates in a spiral segment 43 provided with cap 44. This segment provides a discharge port 46 communicating with the downstream terminal chamber 38 of the sequence.

Whereas in the FIGS. 1–8 embodiment of the invention chambers 28, 30, 32, 34 and 36 are adapted to contain liquid treating and washing agents, either the same or different in selected ones of the chambers, terminal chamber 38 is designed to pass a drying gas which dries the treated and washed film.

To this end, chamber 38 is lined with a low-friction lining 48 of Nylon, Teflon or similar material. Also, terminal chamber 38 is perforated with a plurality of perforations 50 which permit the passage of a gentle flow of drying air.

This flow is generated by the provision of an exhaust fan 52 driven by motor 54 and communicating with chamber 38. Operation of the fan establishes a low pressure condition within the chamber which causes air to flow through perforations 50 in a gentle stream which dries the film before it is discharged through discharge port 46.

The air flow through the drier loops should be directed counter to the direction of travel of the film strip, so that the strip will trail the carriage properly.

An alternate form of treating chamber 38' is illustrated in FIG. 8.

In this form of the invention, the outer vertical surface of the chamber is provided with a pair of laterally spaced deflection recesses 58. A pair of fluid jets 60 is threaded through the wall of the chamber and supplied with treating fluid, water or air under pressure by means of lines 62. The jets create a flow of fluid of predetermined intensity directed against recesses 58 which deflect the stream against the base side of a film contained in the chamber. This prevents the film from touching the surface.

A plurality of carriages are provided for the purpose of drawing the film through the chamber sequence from entrance port 42 to discharge port 46. The construction of typical carriages which may be employed for this purpose is illustrated in FIGS. 3–6 inclusive.

It is to be noted that as the carriages pass from one chamber to the next they may push some of the liquid contents of the chambers ahead of them, thereby transferring it to the next adjacent chamber. In some cases this may be undesirable and accordingly the carriages are designed to overcome the problem.

Figure 3:
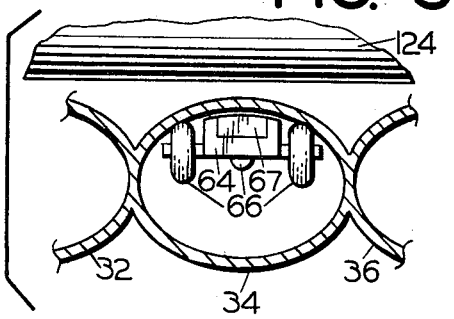
FIG. 3 is a fragmentary, detail sectional view taken along line 3—3 of FIG. 1.
Figure 4:
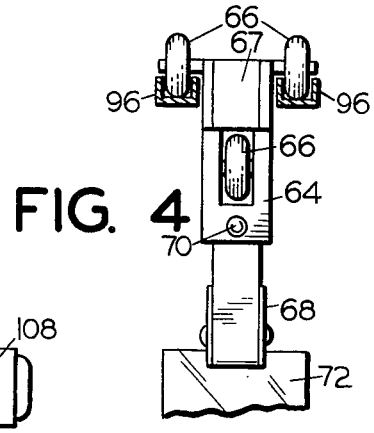
FIG. 4 is a fragmentary, detail sectional view taken along line 4—4 of FIG. 2, FIGS. 3 and 4 illustrating a carriage used in the apparatus for transporting film therethrough.

In the embodiment of FIGS. 3 and 4 each carriage 64 comprises a frame provided with rotatably mounted wheels 66. The frame either is per se magnetic or mounts a piece of magnetic material or magnet 67. If necessary, it may be coated with an inert plastic material such as Teflon to prevent chemical reaction between the substance of the magnetic material and the chemically active liquids contained in the chambers.

The rearward end of the carriage mounts a clip, preferably a spring pressed clip 68, which is attached to the carriage by means of a swivel 70. The clip in turn is adapted to grip releasably a film such as transparency strip 72.

Upon forward movement of the carriage the film streams rearwardly in trailing relation thereto. Accordingly the swivel attachment between the rearward end of the carriage and clip 68 permits self-alignment of the film strip in the chambers as it travels from one to the other.

Since wheels 66 space the carriage from the side walls of the chambers, the transfer of carriage-pushed liquid from one chamber to the next is minimized.

In an alternate form of carriage construction, not illustrated, a single roller may be substituted for wheels 66. In this case, however, the surface of the roller should be grooved or concave in order to permit passage of the treating liquids beneath the roller during movement of the carriage.

Figure 5:
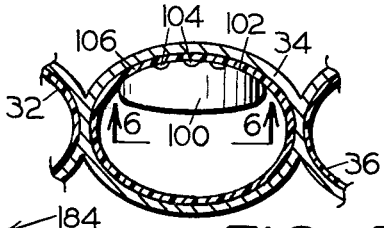
FIG. 5 is a fragmentary, detail sectional view of an alternate form of carriage.
Figure 6:
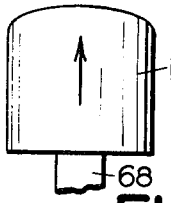
FIG. 6 is a detail, fragmentary bottom plan view of the alternate form of carriage of FIG. 5, looking in the direction of the arrows of line 6—6 of FIG. 5.
Figure 7:
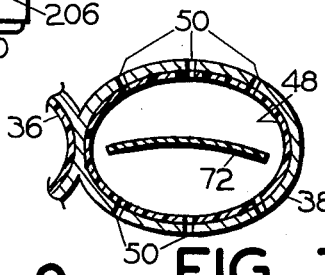
FIG. 7 is a detail sectional view taken along line 7—7 of FIG. 1 and illustrating the application of a drying chamber in the hereindescribed apparatus.

Still another form of carriage is illustrated in FIGS. 5 and 6. It substitutes a sliding body for the wheel or roller mounted frame described above.

Thus the carriage of FIGS. 5 and 6 comprises a body 100 dimensioned to fit within the chambers. It has a sliding surface 102 provided with longitudinal grooves 104. Film strip 72 is releasably attached to the rearward end of the carriage body by clip means (not illustrated) but similar to that above described. If desired, the tubes may be lined with a low friction lining 106 such as Nylon, Teflon or other suitable plastic material.

In operation, the carriage of FIGS. 5 and 6 slides along the inner walls of the tubes with contoured surface 102 in sliding engagement with liner 106. During movement of the carriage, liquid is free to pass beneath it via grooves 104, thereby minimizing transfer of the liquid to the next chamber.

Means are provided for feeding the carriages with attached film strips one at a time into infeed port 42 and for collecting them one at a time as they are discharged from discharge port 46. These sub-assemblies are illustrated in FIG. 2.

At the infeed end of the apparatus there is mounted a downwardly inclined ramp or trough 76. It is dimensioned to receive a plurality of carriages 64 suspended by their front wheels 66 with films 72 dangling freely downwardly. The lowermost carriage 64 is restrained by a component of an escapement assembly which includes a downstream stop bar 78 and an upstream stop bar 80 connected at their lower ends by a walking beam type lever 82. The latter is pivoted intermediate its ends to a support bracket 84 by means of a pivot pin 86.

Pivoted to the same end of walking beam 82 which supports downstream stop bar 78 is a link 88. The lower end of this link is pivotally connected to a lever 90 which is pivoted to the case of chamber 28. A stop 92 maintains the lever at its rest position. A coil spring 94 returns it to its rest position after each actuation.

In use, raising the lower end of lever 90 depresses bar 78 and elevates bar 80. Accordingly, the lowermost one of carriages 64 is permitted to gravitate into the infeed port 42 where it is picked up by the drive of the unit.

The collecting sub-assembly at the discharge end of the apparatus comprises a downwardly inclined ramp or trough 96 also dimensioned to receive carriages 64 and to maintain them in aligned relationship, one behind the other. An abutment or stop 98 is provided at the outer end of the ramp. Accordingly, as the carriages are released one at a time by the drive of the unit, they pass out through discharge port 46 onto trough 96, where they collect until they are removed for further handling.

Carriage actuating means are provided for driving the carriages along the sequence of adjacent aligned chambers. The actuating means are magnetic in character and hence can operate outside the chambers using the concept of leadless transport of the film, with attendant advantages of simplicity and freedom from contamination of the processing solutions.

The magnetic actuating principle may involve the interplay of magnetic forces present between pieces of magnetic material carried by the carriages and an external magnet, magnets carried by the carriages and an external piece of magnetic material, or magnets carried by the carriages and an external magnet. In the latter case the interplay of forces may involve the forces of either magnetic attraction or repulsion.

In the embodiment of the invention illustrated in FIGS. 1–8 a system is disclosed wherein the carriage carries pieces 67 of iron, steel or other magnetic metal and the actuating force is a cooperating exterior magnet. As noted, the pieces of magnetic material may be coated, if desired, with a protective layer of inert plastic.

As shown in FIGS. 1 and 2, the magnetic drive comprises an electric motor 108 bolted to standard 24. The motor is coupled to a first shaft 110 journaled in bearings 112 and mounting sprockets 114.

Cooperating with shaft 110 is a second shaft 116 journaled in bearings 118 supported on standards 22, 24. Shaft 116 mounts sprockets 120. Sprockets 114, 120 mount drive chains 122. The chains support and drive an elongated magnet 124 by means of short connecting shafts 126 carried by the chains.

Elongated magnet 124 may be a long bar magnet, a composite of a multiplicity of smaller permanent magnets, or a composite of electro magnets. It is positioned horizontally inside the helix comprising the sequence of chambers, closely adjacent the inner walls of the latter.

Upon energization of motor 108, chains 122 drive the magnet in a somewhat elliptical reciprocating path corresponding to the configuration of the central opening of the helix. Any carriages within the convolutions of the helix will be attracted by the magnet and carried along the spiral path defined by the helix. In so doing they will traverse the chambers in sequence and the film they transport will be exposed in turn to the various chemical processes and solutions.

The Embodiment of FIGS. 9–13

The form of the invention illustrated in FIGS. 9–13 inclusive is designed to accommodate particularly the processing of film in the form of sheets of varying width, rather than in the form of strip transparencies. In its application, the film is transported in a serpentine, rather than a helical path.

Figure 9:
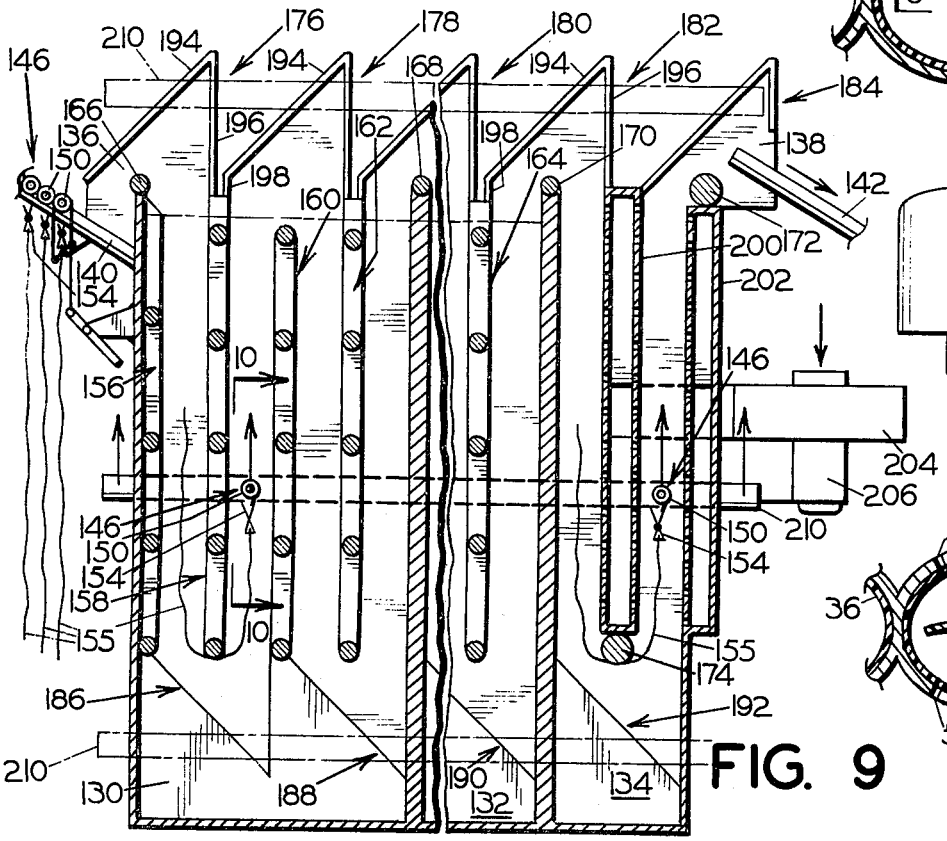
FIG. 9 is a longitudinal sectional view of the apparatus in a second embodiment.

The apparatus comprises a series of tanks or chambers arranged in horizontally aligned relationship and preferably comprising a single compartmented vessel. Thus, as seen in FIG. 9, the apparatus includes a first chamber 130, a second chamber 132 and a third chamber 134. The chambers have a height sufficient to contain the desired amount of treating agent. Their width is preferably but slightly greater than the width of the film to be processed, in order to economize on the amount of treating solution employed.

The chamber sequence has an infeed port 136 at one end and a discharge port 138 at the other end. A downwardly sloping chute or ramp 140 provided with a suitable escapement mechanism is located in working position adjacent the infeed port. A second downwardly inclined ramp or chute 142 is located in working position relative to outfeed port 138. The escapement mechanism, not described in detail, may be the same or similar to that described in connection with the previously illustrated embodiment and shown particularly in FIG. 2.

As also described above, one or more carriages is provided for the leaderless transport of the film through the sequence of chambers. The construction of the carriages is illustrated in FIGS. 10–13 inclusive.

In the form of carriage illustrated in FIGS. 10 and 11, the carriage is indicated generally at 146. It comprises a bar 148 having on each end a telescoping magnetic head 150. The outer face of the magnetic head mounts a non-magnetic ball bearing 152 which bears against the inner sidewall of chamber 130. The telescopic mounting in the head of the bar permits extension of the head until it is immediately adjacent the side wall of the chamber.

If desired, in the case where bar 148 is relatively short, a head 150 may be supplied on one end only of the bar with the other end of the bar extending freely outwardly in unsupported manner.

Bar 148 mounts a plurality of swiveling clips 154 at spaced intervals along its length. The clips in turn support and transport a sheet of film 155. If desired, however, the carriage is adaptable for use with a multiplicity of single film strands each supported by a clip.

In the form of carriage illustrated in FIGS. 12 and 13, the above described carriage structure is modified to include a bar **148*a* having magnetic heads 150*a*. The heads are of substantial diameter to augment the positive magnetic forces exerted upon the carriage as well as to provide increased bearing surface against the side walls of the treating chamber. Each of the heads mounts a plurality of non-magnetic ball bearings 152a.**

Guide means are associated with the apparatus for guiding the carriages and trailing films one at a time through the sequence of chambers.

The guide means are of two categories: Horizontally spaced vertical banks of rollers define parallel vertical passageways to be traversed by the carriages and film. Transverse angular baffles situated at the top and bottom of the passageways act as transition guides for guiding the carriages from one passageway to the next so that the carriage and film traverse a serpentine path as they move through the apparatus.

Thus, chamber 130 is provided with vertically disposed banks of roller guides 156, 158, 160 and 162. Chamber 132 is fitted with vertical banks of roller guides 164. In addition there are individual rollers 166, 168, 170 and 172 mounted at the top of the structure, on the partitions thereof. These are operative during the reverse bending of the film as it travels from one passageway to the next. A single such roller 174 also is located at the bottom of one of the partitions in chamber 134.

It is to be noted that guide rollers 166, 168, 170 and 172 are above the level of liquid contained in the chambers. The remaining rollers are below the liquid level.

The angular transition or direction-changing guides are positioned at the tops and bottoms of the passageways, overlying or underlying a pair of the same. The upper transition guides are indicated at 176, 178, 180 and 182 and 184 respectively; the lower, at 186, 188, 190 and 192 respectively.

The construction of all of the angular transition guides is substantially identical. As illustrated by guide 176, each includes an upwardly sloping transverse segment 194 which connects with a substantially vertical downstream segment 196. In addition, the intermediate transition guides illustrated by guide 178 include short vertical sections 198 at their upstream ends.

In the form of the apparatus illustrated in FIG. 9, chambers 130 and 132 are utilized for processing the film with aqueous solutions. Chamber 134, however, is employed for drying the treated film. Accordingly, it is provided with a pair of chambers 200, 202 each of which has perforated side walls and each of which communicates with a pressure fan 204 driven by a motor 206. Applying pressure to these chambers results in the creation of a gentle flow of air through chamber 134 to achieve the desired drying action.

Reciprocating carriage actuator means of magnetic material is associated with the apparatus of FIGS. 9–12. It is illustrated only schematically in FIG. 9.

As in the case of the previously described embodiment, the actuator means comprises an elongated magnetic element 210. As before, it may comprise either a magnet or piece of magnetic material arranged to secure the desired magnetic drive. However where heads 150, 150*a* are of iron, steel or other magnetic metal, magnetic element 210 comprises an elongated bar magnet which may be a composite of a number of smaller magnets, either permanent or electro.

Bar magnet 210 is driven by a suitable drive such as the chain and sprocket drive of FIGS. 1 and 2, positioned in close proximity to the side walls of chambers 130, 132, 134 and within the fields of effect of magnetic heads 150, 150*a* of the carriages contained therein. This applies a magnetic drive to the carriages and drives them through the apparatus in the manner determined by the drive components thereof.

The Embodiment of FIGS. 14 and 15

Yet another form of the hereindescribed photographic film developing apparatus is illustrated in FIGS. 14 and 15. It is designed particularly for strip film.

As illustrated in FIG. 14, the apparatus comprises a plurality of adjacent, horizontally aligned chambers two of which are indicated at 214 and 216. The chambers are water tight and each is filled to the dashed line level 218 with a selected liquid film treating agent.

The chambers are traversed by a hollow cylinder 220. The surface of the cylinder is marked with a spiral guide groove 222 extending from one end to the other of the cylinder in the feed direction.

Guide groove 222 has outwardly angled side walls, FIG. 15, which lend to the groove in transverse cross section a hexagonal configuration.

The spiral groove serves as a guide or track for carriages one of which is illustrated at 224 in FIG. 15. The body of the carriage is made of magnetic material and its side walls are sloped outwardly substantially to match the contour of the groove. Its bottom surface serves as a sliding surface which slides along the bottom of the groove.

Carriage 224 mounts a swivel clip 226 which is fixed to the carriage by means of a pivot pin 228. The clip is adapted to releasably engage the end of a film strip in the manner described above.

Guide groove 222 functions to support the film in the manner illustrated in FIG. 15. It will be noted that the film is concavely arched in the direction of its emulsion side and engages the side walls of the groove along the film margins only, so that it is supported in the groove with the emulsion side spaced from the defining walls of the groove, thereby protecting the emulsion.

As in the case of the previously described embodiments, there is provided in the embodiment of FIGS. 14–15 a magnetic drive for driving the carriages through the treating chamber in sequence.

The magnetic drive comprises an elongated bar magnet 230 which extends longitudinally within cylinder 220, the entire length thereof. At its ends, the magnet is attached to a pair of crank arms 232. The latter are integral with shafts 234 rotatably mounted in bearings 236. The outer end of at least one shaft 234 is fixed to a chain and sprocket drive 238.

The crank arms 232 have a length predetermined to sweep magnet 230 through an arc which brings it in close proximity to the inner side walls of cylinder 220. Accordingly, magnetic elements comprising the bodies of carriages 224 lie within its field of force and the carriages will be swept along the spiral guide way 222 through the various treating compartments to the discharge end of the apparatus.

OPERATION

In the operation of the embodiments of FIGS. 1–8, chambers 28, 30, 32, 34 and 36 are filled through caps 28*a,* 30*a,* 32*a,* 34*a* and 36*a* with the desired treating agent to the level indicated in FIG. 2. All of the chambers may contain different agents, or certain of them may contain an identical agent.

Film strips 72 are clipped individually to carriages 64 which are arranged on ramp 76 in the manner shown in FIG. 2.

Motor 108 is started, reciprocating the elongated magnet 124 in a substantially elliptical path from the top to the bottom of the apparatus. Exhaust fan 54 is started, pulling a stream of drying air through the perforations of chamber 38. If desired, a stream of nitrogen or other inert gas may be passed through any or all of conduits **28*b*, 30*b*, 32*b*, 34*b* and 36*b*** to prevent oxidation of the treating solutions.

Escapement bars 78, 80 are operated manually, or automatically by motor, through loader arm 90. This permits the lowermost one of the carriage-film assemblies to gravitate into infeed port 42. As the bar magnet 124 sweeps by this port, it magnetically attracts and picks up the carriage and film and draws it alternately upwardly and downwardly through the sequence of convolutions comprising the helix. As it does so, the carriage and film are guided by the corresponding contoured portions of the interior surfaces of the loops (FIGS. 3 and 5).

The film thus traverses the individual treating chambers and is exposed to the selected treating agents for periods of time determined by such factors as the speed of the drive and the height of the helix. It ultimately reaches chamber 38 where it is dried and thereafter discharged through discharge port 46 onto ramp 96: There it abuts against stop 98, awaiting mechanical or manual transfer to further handling.

The foregoing procedure then is repeated again and again to release individual carriages and drive them through the apparatus.

In the embodiment of FIGS. 9–13, the procedure is essentially similar. A single wide film or a plurality of narrow film strps are clipped onto swiveling clips 154 of carriages 148. These are arranged on ramp 140 in the manner indicated in FIG. 9. Chambers 130, 132 are filled with the desired treating solutions to the level indicated by the dashed line of FIG. 9.

Fan 204 is started to pressurize chamber 13, thereby creating a gentle flow of drying air through the chamber. The release lever of the escapement mechanism at the infeed end of the apparatus is tripped, feeding a single one of the carriage-film assemblies gravitationally down ramp 140 until it abuts the outer face of the side wall of chamber 130.

In the meantime, the reciprocating drive for bar magnet 210 has been started. As the magnet sweeps by the carriage, magnetic attraction causes it to pick up the carriage and lift it upwardly until it strikes the upwardly sloping guiding surface 194 of the first of transition guides 176. This causes the carriage and film, to move transversely across the first of several vertical passageways, i.e. the passageway defined by vertical banks of rollers 156, 158.

The downward sweep of the magnet causes the carriage and film to move downward through this passageway until the carriage abuts against the angular guiding surface of transition guide 186. This causes the carriage, and film, to move into the next passageway i.e. the one defined by vertical banks of rollers 158, 160.

This process repeats itself until the carriage and film have passed entirely through treating chambers 130 and 132, and drying chamber 134. They finally are deposited on downwardly sloping discharge ramp 142 where they are collected and removed from the apparatus.

In the operation of the apparatus of FIGS. 14 and 15, chambers 214 and 216 are filled with the treating fluids. Film is clipped to carriage 224 which is introduced into the upstream end of groove 222.

Up and down motion of magnetic element 230 induced by chain and sprocket drive 238 causes the carriage and trailing film to traverse the spiral guide groove, first through chamber 214, then through chamber 216, and thereafter through any succeeding chambers which may be present, thereby accomplishing the desired treatment of the film.

Having thus described my invention in preferred embodiment, I claim:

1. Photographic film processing apparatus, comprising:

a. means defining a series of adjacent, horizontally aligned chambers open at their upper ends, respectively, each of said chambers being adapted to contain a selected film-treating fluid agent;

b. a plurality of first unsymmetrical angular plates mounted at the bottoms of said chambers, respectively;

c. a plurality of second unsymmetrical angular plates mounted at the tops of said chambers in straddling relation across successive chambers, respectively;

d. at least one magnetic carriage arranged in one of said chambers;

e. releasable grip means mounted on said carriage for releasably gripping one end of a length of film, whereby the film is maintained in trailing relation to the carriage;

f. a permanent magnet arranged externally of said chambers, said permanent magnet being a horizontal bar magnet extending the length of said chambers; and g. means for continuously displacing said permanent magnet means vertically relative to said chambers, said second angular plates being so arranged that when the carriage is displaced upwardly toward the top of one chamber, it is displaced by the associated angular plate from the top of one chamber toward the top of the next successive chamber, thereby to effect transport of the carriage in succession through the chambers.

2. Photographic film processing apparatus, comprising:

a. means defining a series of adjacent, horizontally aligned chambers successively communicating with each other at their upper ends, respectively, each of said chambers being adapted to contain a selected film-treating fluid agent;

b. the first one of said chambers having an inlet port and the last one of said chambers having an outlet port;

c. at least one magnetic carriage arranged in one of said chambers, said carriage including a surface adapted for sliding engagement with an inner wall surface of said chamber;

d. releasable grip means mounted on said carriage for releasably gripping one end of a length of film, whereby the film is maintained in trailing relation to the carriage;

e. a permanent magnet arranged externally of said chambers; and f. means for displacing said permanent magnet relative to said chambers to attract said carriage with its sliding surface in engagement with the wall of a chamber and to transport said carriage successively through each of said chambers from said inlet port toward said outlet port;

g. said carriage surface containing a plurality of grooves that extend longitudinally relative to the direction of sliding movement of the carriage, whereby fluid trapped ahead of the traveling carriage will flow through said grooves and thereby remain in said chamber

3. Photographic film processing apparatus comprising:

a. a generally helical tube the convolutions of which define a succession of adjacent, horizontally aligned chambers communicating with each other at their upper ends, respectively, each of said chambers including releasable closure means at the top thereof for the introduction and removal of a film treating agent in the chamber;

b. the first one of said chambers having an inlet port and the last one of said chambers having an outlet port;

c. at least one magnetic carriage arranged in one of said chambers;

d. releasable grip means mounted on said carriage for releasably gripping one end of a length of film, whereby the film is maintained in trailing relation to the carriage;

e. a horizontal permanent magnet arranged within the interior of said helix externally of said chambers, said permanent magnet comprising a bar magnet extending horizontally the length of said helical tube; and f. endless belt means for continuously vertically displacing said magnet along an oval path adjacent the interior of said helix to attract said carriage into engagement with the wall of a chamber and to transport said carriage successively through each of said chambers from said inlet port toward said outlet port.

4. The photographic film processing apparatus of claim 3 wherein the tube is oval in cross section and dimensioned to support the body of the film in spaced relation to the tube.

5. Apparatus as defined in claim 3, wherein said carriage includes a body portion, and means spacing said body portion from the inner wall surface of the associated chamber to permit the flow of fuid between said wall surface and said carriage body, whereby fluid trapped ahead of the traveling carriage will flow through the carriage and thereby remain in said chamber

6. Apparatus as defined in claim 5, wherein said spacing means comprises wheel means connected with said carriage body portion for rolling engagement with the inner surface of the chamber walls.

* * * * *